US007798208B2

(12) United States Patent
Purkis

(10) Patent No.: US 7,798,208 B2
(45) Date of Patent: Sep. 21, 2010

(54) WELLHEAD ASSEMBLY AND METHOD

(75) Inventor: Daniel Purkis, Aberdeenshire (GB)

(73) Assignee: Petrowell Limited, Dyce, Aberdeen (GB)

( * ) Notice: Subject to any disclaimer, the term of this patent is extended or adjusted under 35 U.S.C. 154(b) by 231 days.

(21) Appl. No.: 11/794,847

(22) PCT Filed: Feb. 3, 2006

(86) PCT No.: PCT/GB2006/000356

§ 371 (c)(1),
(2), (4) Date: Jul. 6, 2007

(87) PCT Pub. No.: WO2006/082407

PCT Pub. Date: Aug. 10, 2006

(65) Prior Publication Data

US 2008/0245534 A1 Oct. 9, 2008

(30) Foreign Application Priority Data

Feb. 4, 2005 (GB) ..... 0502298.3

(51) Int. Cl.
*E21B 19/00* (2006.01)

(52) U.S. Cl. ..... 166/75.14

(58) Field of Classification Search ..... 166/75.13, 166/75.14, 89.3, 368; 285/123.13, 123.14, 285/123.3, 123.1, 123.4
See application file for complete search history.

(56) References Cited

U.S. PATENT DOCUMENTS

| | | | | |
|---|---|---|---|---|
| 3,902,743 | A * | 9/1975 | Martin | 285/39 |
| 4,653,778 | A * | 3/1987 | Alandy | 285/18 |
| 5,427,178 | A | 6/1995 | Bland et al. | |
| 6,328,343 | B1 * | 12/2001 | Hosie et al. | 285/90 |
| 6,662,868 | B1 | 12/2003 | Van Bilderbeek | |
| 7,493,944 | B2 * | 2/2009 | Duhn et al. | 166/75.13 |

FOREIGN PATENT DOCUMENTS

| | | |
|---|---|---|
| EP | 0 417 879 | 3/1991 |

* cited by examiner

*Primary Examiner*—Jennifer H Gay
*Assistant Examiner*—Catherine Loikith
(74) *Attorney, Agent, or Firm*—Drinker Biddle & Reath LLP

(57) ABSTRACT

The invention provides a wellhead and a method for installing a wellhead assembly. The wellhead or casing head assembly comprises a first tubular having at least one aperture extending through a side wall thereof. The wellhead or casing head also comprises a second tubular having a recessed portion in the exterior thereof. The second tubular is arranged to be at least partially inserted within the first tubular. The wellhead or casing head assembly also comprises at least one fastening member. The fastening member is removably accommodated within the aperture-(s) and recessed portion. The wellhead also comprises securing means for maintaining the fastening member-(s) within the aperture-(s) and recessed portion. The wellhead further comprises seal means arranged to provide a fluid tight seal.

38 Claims, 5 Drawing Sheets

Fig. 3
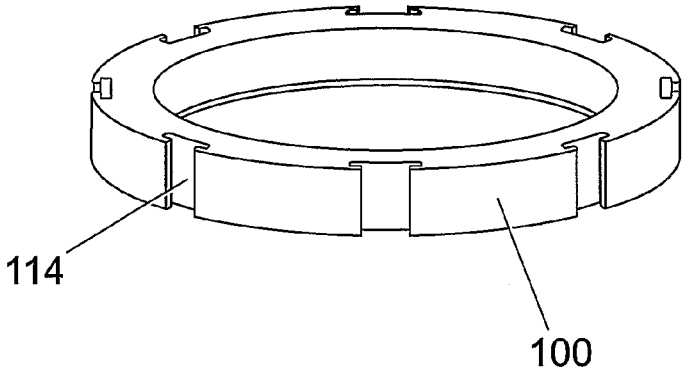
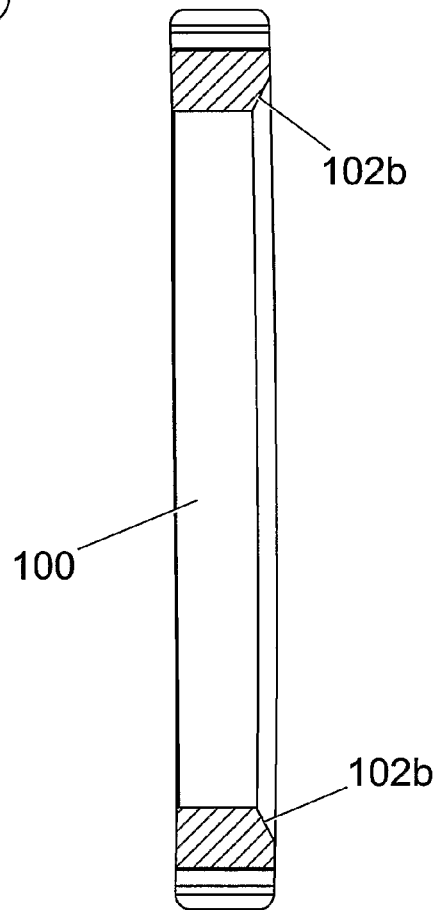
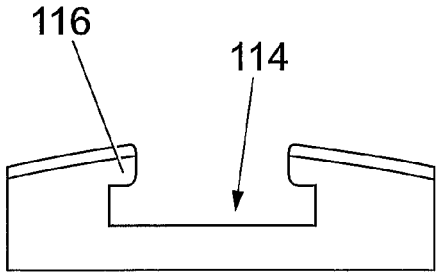
Fig. 5
(section B)
Fig. 4
(A-A)

(A-A)

WELLHEAD ASSEMBLY AND METHOD

RELATED APPLICATION

This Application is the U.S. National Phase Application of PCT International Application No PCT/GB2006/000356 filed Feb. 3, 2006.

FIELD OF THE INVENTION

The present invention relates to a wellhead assembly and method of installing a wellhead. In particular, the assembly and method concern the positioning and locking of a casing hanger or tubing within a hanger spool while minimising the potential for development of multiple leak paths and/or minimising installation time in the field.

DESCRIPTION OF THE RELATED ART

Conventional wellhead designs employ multiple tie down bolts to fix the casing hanger in position within the hanger spool. The tie down bolts must be pressure retaining and are commonly utilised in conjunction with packing glands tied around the exterior of the wellhead to provide a more reliable seal. This arrangement gives rise to a number of potential leak paths which may be hazardous, especially in the event that high pressure gas is contained within the wellhead assembly.

BRIEF SUMMARY OF THE INVENTION

The object of the present invention is to provide an improved wellhead or casing head assembly and method for installing the same which preferably alleviates any one of or all of the problems associated with the prior art.

According to a first aspect of the present invention there is provided a wellhead or casing head assembly comprising:

- a first tubular having at least one aperture extending through a sidewall thereof;
- a second tubular having a recessed portion in the exterior thereof and arranged to be at least partially inserted within the first tubular;
- at least one fastening member wherein the or each fastening member is removably accommodated within the aperture(s) and recessed portion;
- securing means for maintaining the fastening member(s) within the aperture(s) and recessed portion; and
- seal means arranged to provide a fluid tight seal.

According to a second aspect of the present invention there is provided a method for installing a wellhead assembly comprising the steps of:—

- providing a first tubular having at least one aperture extending through a side wall thereof;
- providing a second tubular having a corresponding recess in the exterior thereof;
- locating the second tubular within the first tubular;
- inserting a fastening member in the or each aperture and corresponding recess; and
- securing and sealing the fastening member(s) within the respective aperture(s) and recess.

Preferably, the first tubular comprises a plurality of apertures having corresponding fastening members, most preferably two such apertures. Preferably, the at least two fastening members are selectively moveable between an engaged configuration in which they are located within both of the apertures and the recessed portion and a disengaged configuration in which they are not located within the recessed portion, but may or may not be located within the apertures.

A plurality of apertures can be provided in the first tubular. These can be evenly spaced around the sidewall of the first tubular. Each aperture can be provided with a respective fastening member. Preferably each aperture is arranged with its longitudinal axis substantially perpendicular to the longitudinal axis of the first and/or second tubulars. Preferably the recess is formed around the entire outer circumference of the second tubular.

Each fastening member can comprise a dog bolt and/or locking dog arrangement. In the engaged configuration, the or each fastening member is arranged to prevent axial movement of the second tubular with respect to the first tubular.

Typically the or each fastening member is/are located within the aperture when in the engaged configuration, with their longitudinal axis substantially perpendicular to the long axis of the first and/or second tubular. In this manner the or each fastening member projects from the first tubular into the recess of the second tubular and thereby presents an impediment to relative longitudinal movement occurring between the first and second tubulars.

The securing means can comprise a plate or flange held in place over an outer end of the fastening member. The securing means may further comprise nuts and bolts to hold the flange in place. Securing means are provided to resist movement of the or each fastening member out of the aperture(s) and recessed portion in which they are accommodated in the engaged configuration. Typically the securing means prevent unwanted radially outward movement of the fastening members from occurring whilst the fastening members are in the engaged configuration. The securing means can perform the dual function of allowing the seal means to be incorporated into the apparatus in position between the fastening member and the exterior of the first tubular.

Preferably, the seal means are provided to create a fluid tight seal and can seal at least a portion of the area between the securing means and the fastening member.

The seal means can surround the periphery of the outer end of the or each aperture in the first tubular. A groove in the exterior of the first tubular surrounding each aperture can be provided. A corresponding groove can be provided on an internal face of the securing means. Each groove can be configured to at least partially accommodate the seal means. Suitable seal means include at least one metal ring joint. In addition or as an alternative, seal means can comprise at least one rubber O-ring seal. One advantage of using annular metal seals is that, in the preferred embodiment utilising two or more fastening members, such an assembly may rely on as few as two metal to metal seals to contain pressure.

The first tubular can be a hanger spool and can be at least partially accommodated within a casing or wellhead. The second tubular can be a casing hanger. Annular seals can be provided to seal the exterior of the second tubular within the first tubular. At least two such seals can be provided: at least one positioned above the recesses and at least one other located below the recesses and such annular seals are preferably in the form of 'O' ring seals or other suitable elastomeric seals.

The apparatus and method of the present invention is suitable for locking and sealing any two or more adjacent tubulars within a wellbore.

Embodiments of the method of the present invention have significant benefits over existing methods since the time required for installation of the wellhead assembly is significantly reduced.

BRIEF DESCRIPTION OF THE SEVERAL VIEWS OF THE DRAWINGS

One embodiment of the present invention will now be described, by way of example only, with reference to and as shown in the accompanying drawings, in which:

FIG. 3 is a perspective view of the component of FIG. 2;

FIG. 4 is a sectional side view along the line A-A of the component of FIG. 2;

FIG. 5 is in an enlarged view of section B shown in FIG. 2;

DETAILED DESCRIPTION OF THE INVENTION

Figure 1:
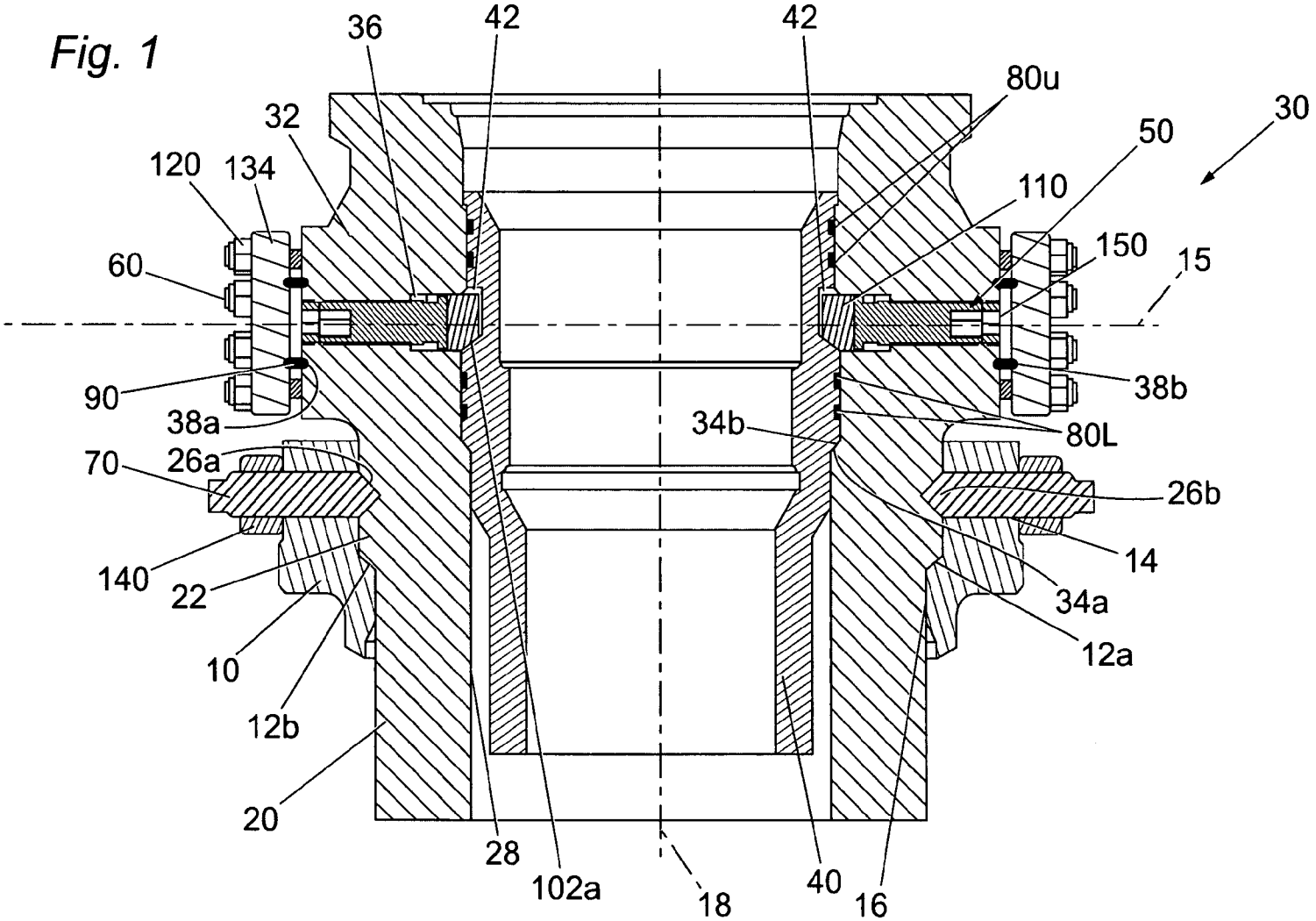
FIG. 1 is a sectional view of an assembled wellhead in accordance with the present invention.

Wellhead completion apparatus according to one embodiment of the present invention is shown generally at 30 in FIG. 1. The apparatus 30 includes a hanger spool 20 and a casing hanger 40 with means of securing and sealing these components with respect to one another, which are described hereinafter.

The apparatus 30 is shown assembled within a casing head 10 having a throughbore 16 which defines an inner diameter of approximately 30 inches (76.2 cm). The interior of the casing head 10 is provided with an upwardly projecting annular shoulder 12*a*. The casing head 10 has twelve apertures 14 (two of which are shown in the sectional view of FIG. 1) extending through the sidewall thereof.

The exterior of the hanger spool 20 is provided with a downwardly projecting annular shoulder 12*b* thereby defining a shoulder portion 22. The angle of the downwardly projecting annular shoulder 12*b* corresponds to the angle of the upwardly projecting annular shoulder 12*a* such that on placement of the hanger spool 20 within the casing head 10, the annular shoulders 12*a* and 12*b* are in abutment.

The shoulder portion 22 of the hanger spool 20 is provided with twelve V-shaped notches 26*a* in the exterior thereof.

The hanger spool 20 is also provided with a throughbore 28 which defines a 20 inch (50.8 cm) inner diameter. The inner diameter of the hanger spool 20 has an upwardly projecting shoulder portion 34*a*.

The upper part of the exterior of the hanger spool 20 is provided with an enlarged portion 32. The upper enlarged portion 32 of the hanger spool 20 has two apertures 36 (both of which are shown in FIG. 1) extending through the sidewall thereof at diametrically opposite locations such that the apertures 36 are directed substantially perpendicularly along radial axes 15 with respect to the longitudinal axis 18 of the hanger spool 20. The external opening of each aperture 36 in the upper enlarged portion 32 of the hanger spool 20 is surrounded by an annular groove 38*a*.

Each groove 38*a* in the exterior of the hanger spool 20 can accommodate a portion of an annular metal ring joint 90. Two flanges 134 are provided, the inner face of which has an annular groove 38*b* in which a portion of the metal ring joint 90 is accommodated.

The casing hanger 40 has an outer diameter which is provided with a downwardly projecting shoulder portion 34*b* for abutment with the corresponding upwardly projecting shoulder 34*a* on the interior of the hanger spool 20.

The casing hanger 40 is provided with a single recess 42 extending for 3600 around the outer circumference of the casing hanger 40, and is thus in the form of a continuous groove 42. The recess 42 has a tapered section 102*a*. Two annular seals 80U, 80L are provided at each upper and lower side of the recess 42 on the exterior of the casing hanger 40.

The apertures 36 and corresponding recess 42 are of sufficient size to accommodate a dog bolt 50 and a locking dog 110 respectively. A component 100 from which locking dogs 110 are obtained is shown in greater detail in FIGS. 2-5.

Figure 2:
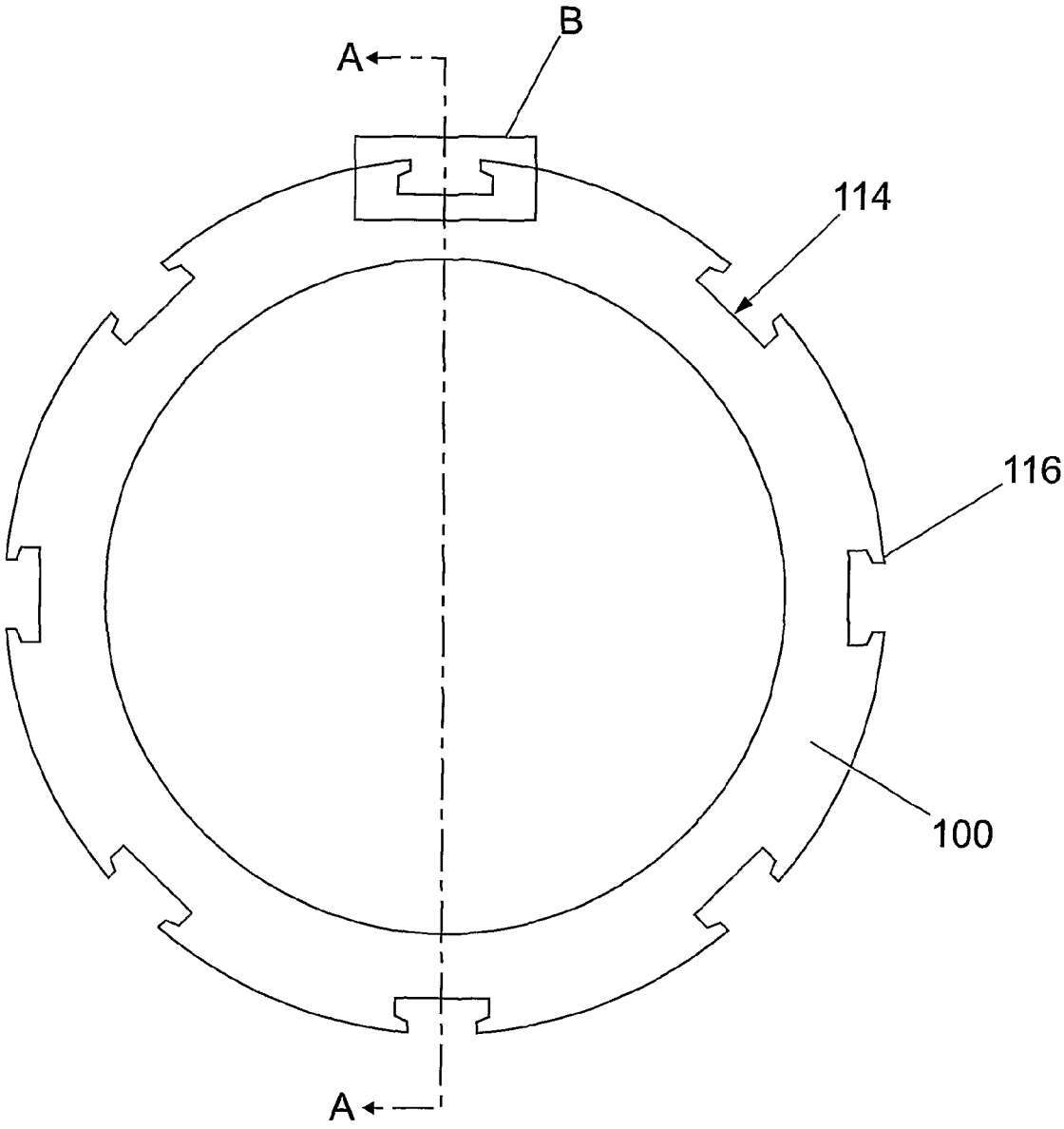
FIG. 2 is a top view of a component from which locking dogs are made.
Figure 7:
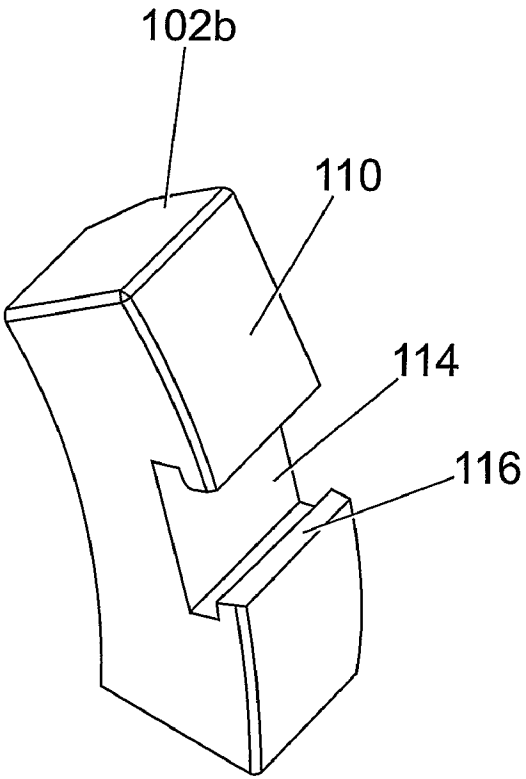
FIG. 7 is an enlarged perspective view of a portion of one of the locking dogs of FIG. 6.
Figure 6:
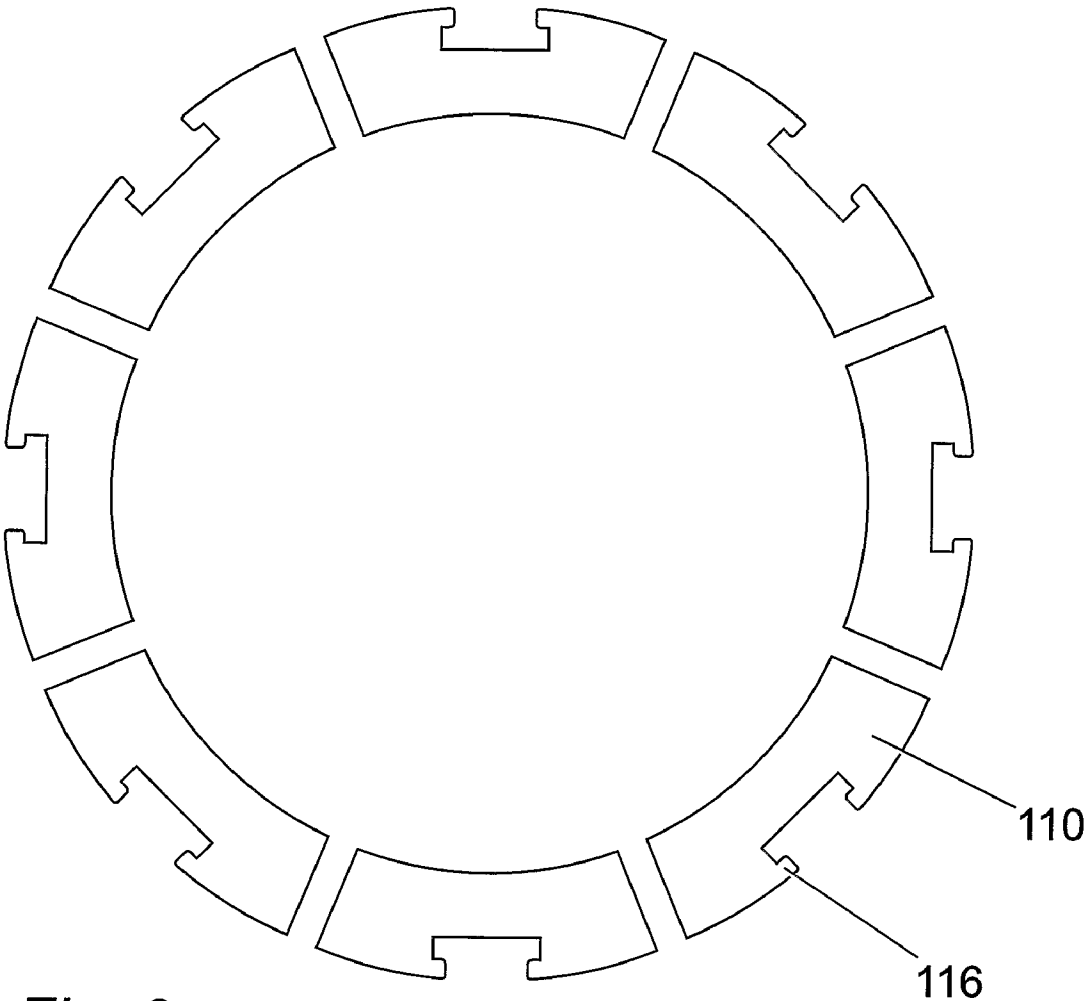
FIG. 6 is a top view of eight locking dogs, two of which are used in the assembled wellhead of FIG. 1.
Figure 9:
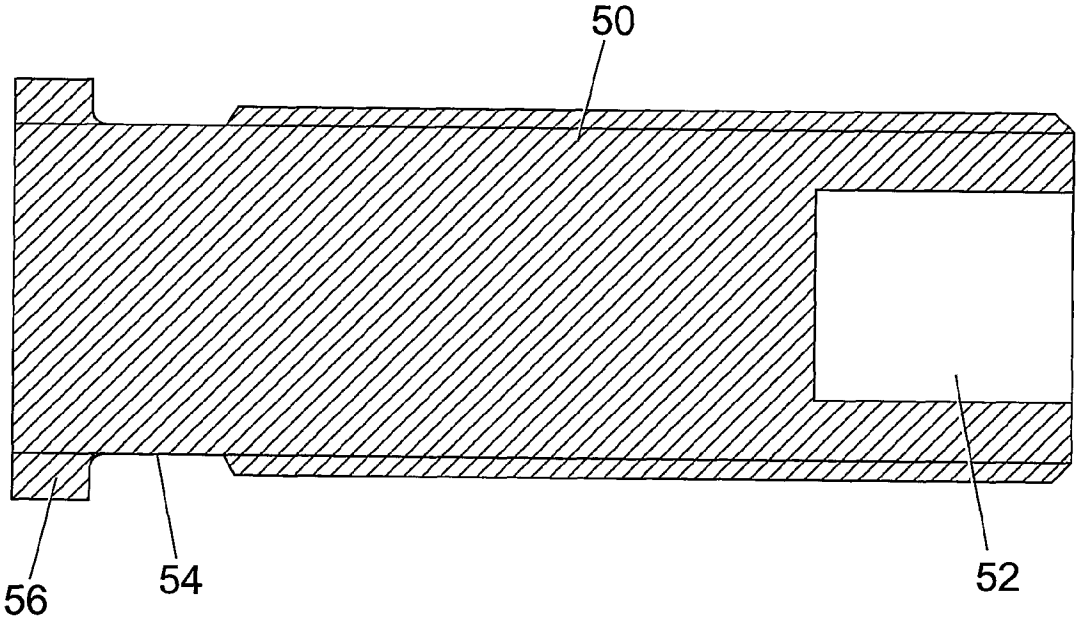
FIG. 9 is a sectional view of the dog bolt of FIG. 8 along the line A-A.

As shown in FIG. 2, the component 100 is annularly shaped with eight T-shaped slots 114 in the exterior thereof. Section B shown in FIG. 5 provides a detailed view of a portion of the component 100 having a T-shaped slot 114. Each T-shaped slot 114 defines a rim 116. Section A-A of FIG. 4 shows that one side of the component 100 is provided with a tapered section 102*b*. Component 100 is cut into eight separate identical segments as shown in FIG. 6. Each segment is a locking dog 110, a detailed perspective view of which is shown in FIG. 7.

Figure 8:
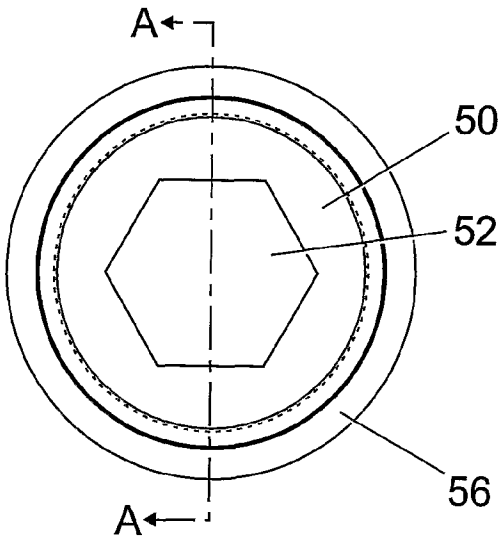
FIG. 8 is an end view of a dog bolt used in the present invention.

FIG. 8 is an end view of a dog bolt 50. The dog bolt 50 has a hexagonal recessed end portion 52, an annular depression 54 and a projecting rim 56.

Before operational use, the apparatus 30 is assembled within the casing head 10 where the casing head 10 is already located at the opening of a borehole (not shown). The casing head 10 acts as an annular rim to line the mouth of the borehole. The hanger spool 20 is inserted in the throughbore of the casing head 10 until the downwardly projecting shoulder portion 12*b* abuts the upwardly projecting shoulder portion 12*a*. Lock down bolts 70 are provided having a V-shaped end portion 26*b* which corresponds with the V-shaped notches 26*a* in the enlarged portion 32 of the hanger spool 20. Each aperture 14 in the casing head 10 has one lock down bolt 70 inserted therein and extending therethrough. Each bolt 70 is held in place by a corresponding heavy duty nut 140.

The head 56 of each dog bolt 50 is accommodated by T-shaped slots 114 of the locking dog 110. In this configuration, the rim 116 of the locking dog 110 is positioned in the annular depression 54 of the dog bolt 50 which prevents each locking dog 110 and dog bolt 50 from being pulled apart. The assembled locking dogs 110 and dog bolts 50 are inserted in each aperture 36. The locking dogs 110 and attached dog bolts 50 are then retracted to allow the casing hanger 40 to be landed within the throughbore 28 of the hanger spool 20. The hanger spool 20 is now ready to receive the casing hanger 40 whenever the operator requires to run a casing string into the borehole and suspend it from the casing hanger 40. The operator will lower the casing hanger 40 into the bore 28 of the hanger spool 20 until the upwardly facing annular shoulder 34*a* of the hanger spool 20 abuts the downwardly projecting annular shoulder 34*b* of the casing hanger 40 and thus downwards movement of the casing hanger 40 is arrested. In this position the recessed portion 42 is aligned with the apertures 36 in the hanger spool 20.

Once the casing hanger 40 is in position, the locking dogs 110 are moved radially inwardly such that they are positioned in the recess 42 provided in the casing hanger 40. The tapered section 102*b* of each locking dog 110 abuts the tapered portion 102*a* of the recess 42. Locking screws 150 are inserted into the recessed end portions 52 having a hex socket head and are used to maintain the dog bolts 50 in position.

Metal ring joints 90 are placed in annular grooves 38*a*. Flanges 134 are positioned to cover each aperture 36 having the dog bolts 50 and locking screws 150 inserted therein, such that the groove 38*b* on the inner face of each flange 134 accommodates a portion of metal ring joint 90. Flanges 134 have holes extending therethrough (not shown). Studs 60 are inserted within the holes in each flange 134 and locked in place by nuts 120.

Accordingly, the flanges 134 provide a means of securing the locking dogs 110 in the engaged position in that they prevent the dog bolts 50 and thus the locking dogs 110 from moving radially outwardly. Furthermore, the locking dogs 110 provide a means of releasably fastening the casing hanger 40 to the hanger spool 20 in that the locking dogs 110 prevent any undesirable upward movement of the casing hanger 40 with respect to the hanger spool 20.

In use hydrocarbons often at high pressure are produced up various conduits in the wellbore. Accordingly the wellhead assembly is required to withstand high pressures without the risk of potentially dangerous leak paths developing.

The apparatus 30 employs various means to prevent the development of leak paths. Annular seals 80 provide a seal between the hanger spool 20 and casing hanger 40. Additionally, annular metal seals 90 are pressure retaining by virtue of their position in the grooves 38*a* and 38*b* in the exterior of the hanger spool 20 and flange 134 respectively.

Modifications and improvements may be made to the embodiments hereinbefore described without departing from the scope of the invention.

The invention claimed is:

1. A wellhead assembly comprising:

a first tubular having at least one aperture extending through a sidewall thereof;

a second tubular having a recessed portion in the exterior thereof and arranged to be at least partially inserted within the first tubular;

at least one fastening member wherein the at least one fastening member is removably accommodated within the aperture(s) and recessed portion;

a securing mechanism for maintaining the fastening member(s) within the aperture(s) and recessed portion, wherein the securing mechanism is located outside of an outer end of the at least one fastening member and at least a portion of the securing mechanism is along an axis that extends through the at least one fastening member; and a seal arrangement to provide a fluid tight seal, wherein the seal arrangement comprises an annular seal ring located around the periphery of the outer end of the at least one aperture and positioned between the said at least a portion of the securing mechanism and the periphery of the outer end of the at least one aperture, wherein the annular seal ring is arranged to seal an area between the said at least a portion of the securing mechanism and the periphery of the outer end of the at least one aperture.

2. A wellhead assembly according to claim 1, wherein the at least one aperture is arranged with its longitudinal axis substantially perpendicular to the longitudinal axis of the first and second tubulars.

3. A wellhead assembly according to claim 1, wherein the at least one fastening member is selectively moveable between an engaged configuration in which it is located within the apertures and the recessed portion and a disengaged configuration in which it is not located within the recessed portion.

4. A wellhead assembly according to claim 3, wherein in the engaged configuration, the at least one fastening member is arranged to restrict axial movement of the second tubular with respect to the first tubular.

5. A wellhead assembly according to claim 4, wherein in the engaged configuration, the at least one fastening member projects from the first tubular into the recess of the second tubular and thereby restricts relative longitudinal movement occurring between the first and second tubulars.

6. A wellhead assembly according to claim 3, wherein the securing mechanism resists movement of the at least one fastening member out of the aperture(s) and recessed portion in which they are accommodated in the engaged configuration.

7. A wellhead assembly according to claim 1, wherein the securing mechanism comprises a flange.

8. A wellhead assembly according to claim 7, wherein the flange is positioned over an outer end of the at least one fastening member.

9. A wellhead assembly according to claim 7, wherein the flange is bolted to the first tubular.

10. A wellhead assembly according to claim 1, wherein a groove is provided in the exterior of the first tubular surrounding the at least one aperture.

11. A wellhead assembly according to claim 10, wherein a further groove is provided on the securing mechanism.

12. A wellhead assembly according to claim 10, wherein each groove is configured to at least partially accommodate the annular seal ring.

13. A wellhead assembly according to claim 1, wherein the seal annular seal ring is a metal ring joint.

14. A wellhead assembly according to claim 1, wherein the at least one fastening member comprises a dog bolt.

15. A wellhead assembly according to claim 1, wherein the at least one fastening member comprises a locking dog.

16. A wellhead assembly according to claim 1, wherein the first tubular comprises a plurality of apertures having corresponding fastening members.

17. A wellhead assembly according to claim 1, wherein the apertures are evenly spaced around the sidewall of the first tubular.

18. A wellhead assembly according to claim 1, wherein the first tubular has two diametrically opposing apertures.

19. A wellhead assembly according to claim 1, wherein the recessed portion is formed around the outer circumference of the second tubular.

20. A wellhead assembly according to claim 1, wherein the first tubular is a hanger spool.

21. A wellhead assembly according to claim 1, wherein the second tubular is a casing hanger.

22. A wellhead assembly according to claim 1, wherein annular seals are provided to seal the exterior of the second tubular within the first tubular.

23. A wellhead assembly according to claim 22, wherein at least two such seals are provided.

24. A wellhead assembly according to claim 22, wherein at least one seal is positioned above the recessed portion and the at least one other seal is located below the recessed portion.

25. A wellhead assembly according to claim 22, wherein such annular seals are elastomeric 'O' ring seals.

26. A method for installing a wellhead assembly comprising the steps of:

providing a first tubular having a bore and a sidewall, and wherein the sidewall has at least one aperture extending therethrough;

providing a second tubular having an exterior and wherein the exterior has a corresponding recess therein;

locating the second tubular within the bore of the first tubular;

inserting a fastening member in the at least one aperture and corresponding recess;

securing and sealing the fastening member(s) within the respective aperture(s) and recess by surrounding the periphery of the outer end of the at least one aperture with an annular seal ring and locating a securing mechanism outside of an outer end of the at least one fastening member wherein at least a portion of the securing mechanism is along an axis that extends through the at least one fastening member such that the annular seal ring seals an area between the said at least portion of the securing mechanism and the periphery of the outer end of the at least one aperture.

27. A method for installing a wellhead assembly according to claim 26, wherein the first and second tubulars each have a long axis and wherein the at least one aperture is provided substantially perpendicular to the long axis of the first and second tubulars.

28. A method for installing a wellhead assembly according to claim 26, including selectively moving the fastening members between an engaged configuration in which they are located within the at least one aperture and a disengaged configuration in which they are not located within the at least one aperture.

29. A method for installing a wellhead assembly according to claim 28, including restricting relative longitudinal movement between the first and second tubular in the engaged configuration by providing the fastening member projecting therebetween.

30. A method for installing a wellhead assembly according to claim 26, including providing a corresponding annular groove in the exterior of the first tubular surrounding the at least one aperture.

31. A method for installing a wellhead assembly according to claim 26, including at least two apertures evenly spaced around the sidewall of the first tubular.

32. A method for installing a wellhead assembly according to claim 26, including fastening the first tubular and the second tubular by inserting a dog bolt and a locking dog into the at least one aperture and recess.

33. A method for installing a wellhead assembly according to claim 26, wherein the securing mechanism resists movement of the at least one fastening member out of the at least one aperture and corresponding recess in the engaged configuration.

34. A method for installing a wellhead assembly according to claim 33, including positioning a flange over an outer end of the at least one fastening member.

35. A method for installing a wellhead assembly according to claim 34, including bolting the flange in position.

36. A method for installing a wellhead assembly according to claim 7, including providing an annular groove in the securing mechanism.

37. A method for installing a wellhead assembly according to claim 36, including configuring the at least one groove to at least partially accommodate the annular seal ring.

38. A method for installing a wellhead assembly according to claim 37, including providing a metal ring joint to act as the annular seal ring.

* * * * *

UNITED STATES PATENT AND TRADEMARK OFFICE

CERTIFICATE OF CORRECTION

PATENT NO. : 7,798,208 B2
APPLICATION NO. : 11/794847
DATED : September 21, 2010
INVENTOR(S) : Purkis It is certified that error appears in the above-identified patent and that said Letters Patent is hereby corrected as shown below:

Column 6, Claim 13, line 30 - change "seal annular" to -- annular --

Signed and Sealed this

Twenty-first Day of December, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,798,208 B2
APPLICATION NO. : 11/794847
DATED : September 21, 2010
INVENTOR(S) : Purkis It is certified that error appears in the above-identified patent and that said Letters Patent is hereby corrected as shown below:

Column 8, Claim 36, line 23 - change "7" to -- 30 --

Signed and Sealed this
Fifteenth Day of February, 2011

David J. Kappos

David J. Kappos
*Director of the United States Patent and Trademark Office*